United States Patent [19]

White

[11] 4,157,148

[45] Jun. 5, 1979

[54] MODIFIED FEED FRAMES FOR TABLETING MACHINE

[75] Inventor: Gilbert H. White, Kalamazoo, Mich.

[73] Assignee: The Upjohn Company, Kalamazoo, Mich.

[21] Appl. No.: 814,541

[22] Filed: Jul. 11, 1977

[51] Int. Cl.[2] ..... B30B 11/08

[52] U.S. Cl. ..... 222/346; 198/954; 222/424; 425/182; 425/345

[58] Field of Search ..... 264/297, 334; 425/215, 425/216, 217, 231, 344, 345, 182; 222/344, 345, 346, 347, 318, 370, 424; 198/537, 954

[56] References Cited

U.S. PATENT DOCUMENTS

| | | | |
|---|---|---|---|
| 2,043,086 | 6/1936 | Westin et al. | 425/182 |
| 2,992,729 | 7/1961 | Curtius | 425/345 X |
| 3,158,111 | 11/1964 | Raff | 425/345 X |
| 3,276,079 | 10/1966 | Cohn | 425/345 |

*Primary Examiner*—David A. Scherbel

*Attorney, Agent, or Firm*—Blanchard, Flynn, Thiel, Boutell & Tanis

[57] ABSTRACT

A multiple compartment feed frame for supplying powder to the dies of a tableting machine, wherein a relief opening is provided in the leading compartment to permit excess powder to escape therefrom and be subsequently introduced either into a trailing compartment or collected and re-introduced into the leading compartment, whereby the level of powder in the leading compartment is maintained substantially constant in spite of fluctuations in the supply of powder thereto.

8 Claims, 7 Drawing Figures

MODIFIED FEED FRAMES FOR TABLETING MACHINE

FIELD OF THE INVENTION

This invention relates to a tableting machine for use in the pharmaceutical industry and relates particularly to improvements in the feed frame thereof whereby to render more constant the density of powder supplied to the tableting dies.

BACKGROUND OF THE INVENTION

Tableting machines have been known for many years and one particular type thereof which has received a high level of development and is widely used comprises a rotary table containing die openings therein, together with means for introducing powder for tableting into such die openings, upper and lower punches for compressing such powder into tablets and means for ejecting the tablets from said openings.

There is, however, a continuing problem in the operation of such machines in that different formulations of powder have a wide range of varying physical characteristics which results in varying substantially the capacity of said powder to flow through the feeding mechanism, to be received into the die openings and to be compressed into tablets. Such variations if uncontrolled will lead to wide variations in the density, and consequently weight, of the finished tablets. Since the weights of such tablets to be acceptable must be held within a predetermined range and since any tablets out of this range are essentially a loss to the pharmaceutical company, it is obviously desirable to hold the variations in tablet weight to within such range.

A great amount of effort has gone into controlling the feeding of powders to the dies of a tableting machine and the machines now in commercial use have attained a high degree of sophistication. In some instances, automatic means have been provided for sensing the pressure developed in forming the tablets and adjusting the feed as needed to maintain the pressure within a specified range. For example, strain sensing equipment has been installed into a tableting machine for sensing the tablet pressures generated therein when the tablet forming punches are brought together. The signal produced by the sensing equipment is used for controlling feed to the tablet dies. These, however, are truly effective only for relatively lengthy variations in powder feed and are not particularly effective in handling more rapid pulsations in powder supply which are normally referred to in the industry as the starve/flood cycle. Some control over this is obtained by applying tape to control the size of the openings in the feed frame of the tableting machine, and in making various other adjustments in the powder controlling openings within such feed frame but these require long set-up times, often a matter of several hours, and even at best are not fully successful.

Accordingly, the objects of the invention include:

1. To provide a feed frame applicable to a standard tableting machine as used in the pharmaceutical industry whereby to minimize the fluctuations in density of powder within the tableting dies as a result of the starve/flood cycles normally experienced in conventional tableting machines.

2. To provide a feed frame, as aforesaid, which is in most respects substantially similar to presently known feed frames and which can therefore be utilized in a known manner on presently known equipment.

3. To provide a feed frame, as aforesaid, which can be obtained by relatively simple modification of presently known feed frames whereby to utilize in an improved manner feed frames already in existence.

4. To provide a feed frame, as aforesaid, which can be adjusted as needed in a simple manner to adapt a given feed frame to powders having given flow characteristics.

5. To provide a feed frame, as aforesaid, which will minimize the set-up time required to adjust the feed frame to a given powder.

6. To provide a feed frame, as aforesaid, which, when once properly adjusted, will be self-compensating for variations in the quantities of powder supplied to it and supply substantially uniform quantities of powder to the successively presented tableting dies.

The feed frame of the invention will have other and further advantages as will be apparent to persons acquainted with equipment of this general type upon reading the following specification and inspection of the accompanying drawings.

SUMMARY OF THE INVENTION

Briefly stated, the invention is based upon a presently known type of feed frame comprising three successively arranged compartments or enclosures positioned on the rotary table and bearing against the surface in which the tableting dies are located. Powder is fed into the leading one of such compartments and passes through appropriate openings in the walls therebetween into the second and third compartments following. Thus, the walls of the compartment act as scrapers with respect to the table surface but the presence of successive bodies of powder assists in insuring complete filling of each of the successively presented dies.

According to the invention, a bypass channel is provided between a leading compartment and a compartment trailing with respect thereto whereby powder entering such leading compartment as a result of surges from the means feeding same can be conducted downstream therefrom and thus the powder in said compartment maintained at a substantially constant level. Said leading compartment in the disclosed embodiment is the first compartment, namely the compartment into which the hopper discharges and the bypass means extends from said first compartment to either or both of the last trailing compartment, or after some attenuation back to the first compartment.

DETAILED DESCRIPTION

Figure 1:
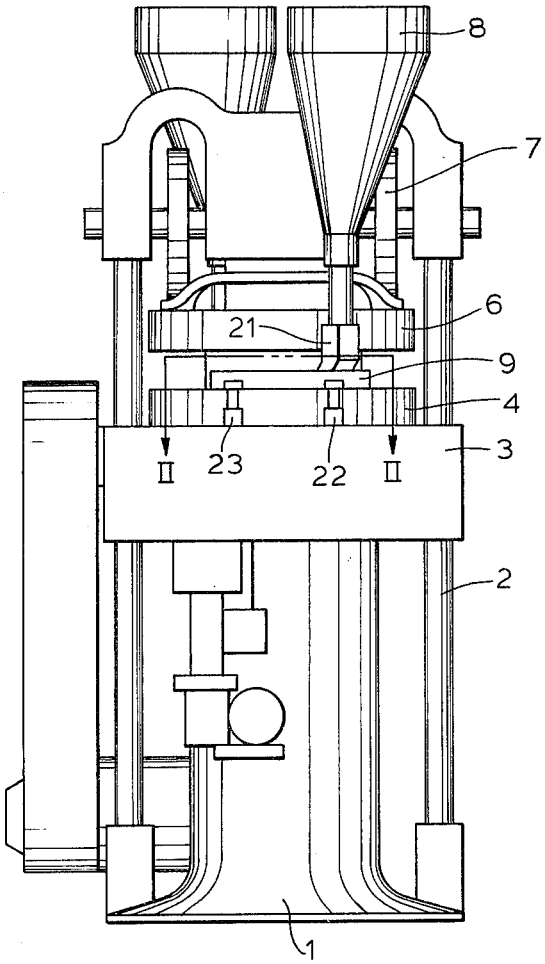
FIG. 1 is a generalized elevation view of a tableting machine, same including the feed frame of the invention.

Referring now to the drawings in detail, there is shown in FIG. 1 a tablet feeding machine embodying the invention. This machine is presented solely for illustrative purposes and will illustrate the environment in which the invention is placed. It should be understood, however, that the invention is applicable to a wide range of presently known tableting machines provided only that such machines utilize a rotary table with the tableting dies recessed into the upper horizontal face of such table.

In FIG. 1 the machine comprises a base structure 1 supporting strain rods 2 which carry a platen 3 on which is mounted a horizontal rotating table 4. A plurality of conventional upper punches (not shown) are vertically reciprocal in an upper punch carrier 6 and are caused to depress in a conventional manner by rollers of which one is shown at 7. Suitable hoppers, here two, of which one is shown at 8, are provided for feeding tableting powder to a feed frame 9 which defines a series of enclosures or compartments for said powder. Said feed frame is both a guide and a scraper for guiding and moving said powders along the upper face of the rotary table and depositing them in the successively presented die openings. Same are then compressed in a conventional manner and ejected from the machine by conventional means not shown.

Figure 2:
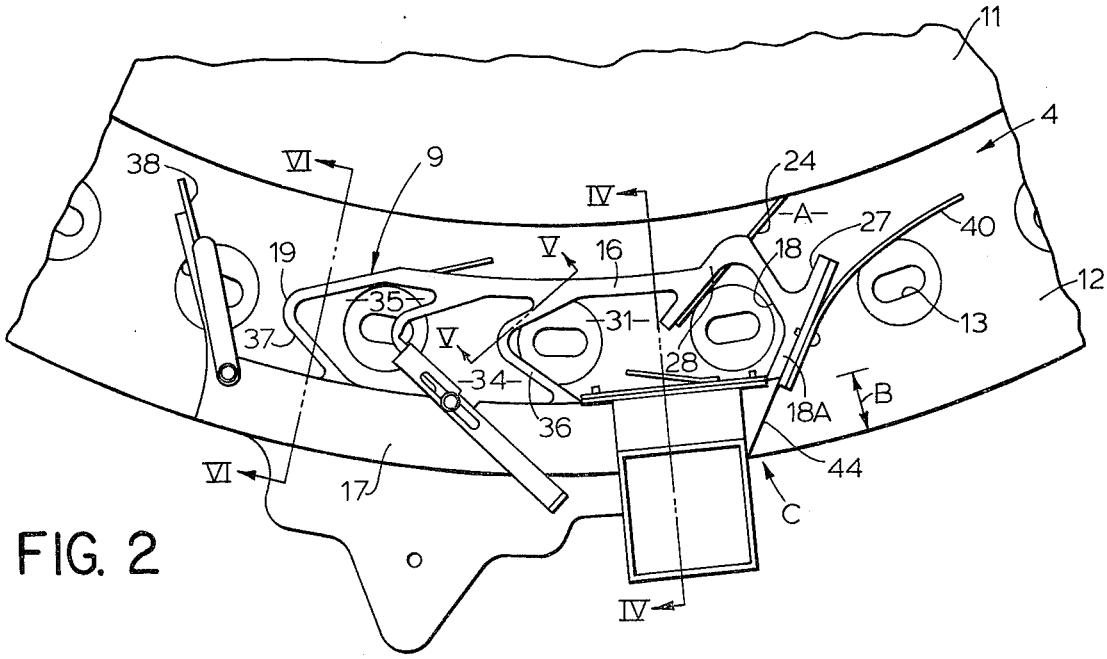
FIG. 2 is a top fragmentary view of the rotary table of said tableting machine taken on line II—II of FIG. 1, and showing a feed frame of the invention in operative association therewith.

Turning now to FIG. 2 there is shown a portion of the table 4 which is here provided with a raised hub 11 and has on its stepped surface 12 a plurality of recesses 13 spaced successively along a circle parallel with the circumference of said table. Said recesses comprise the tableting dies and are entered from both above and below by suitable punches for affecting in a conventional manner the compressing of the powder into the desired tablets.

Positioned on the stepped surface 12 is the feed frame 9. It is in this embodiment a generally ovate structure having sides 16 and 17 with somewhat curved ends 18 and 19. The lower end of each hopper, as the hopper 8, extends into a feed box 21 through which powder is supplied into the space within the feed frame 9, and the feed box is secured to the feed frame. Accordingly, movement of the hopper does not affect the feed frame.

Figure 3:
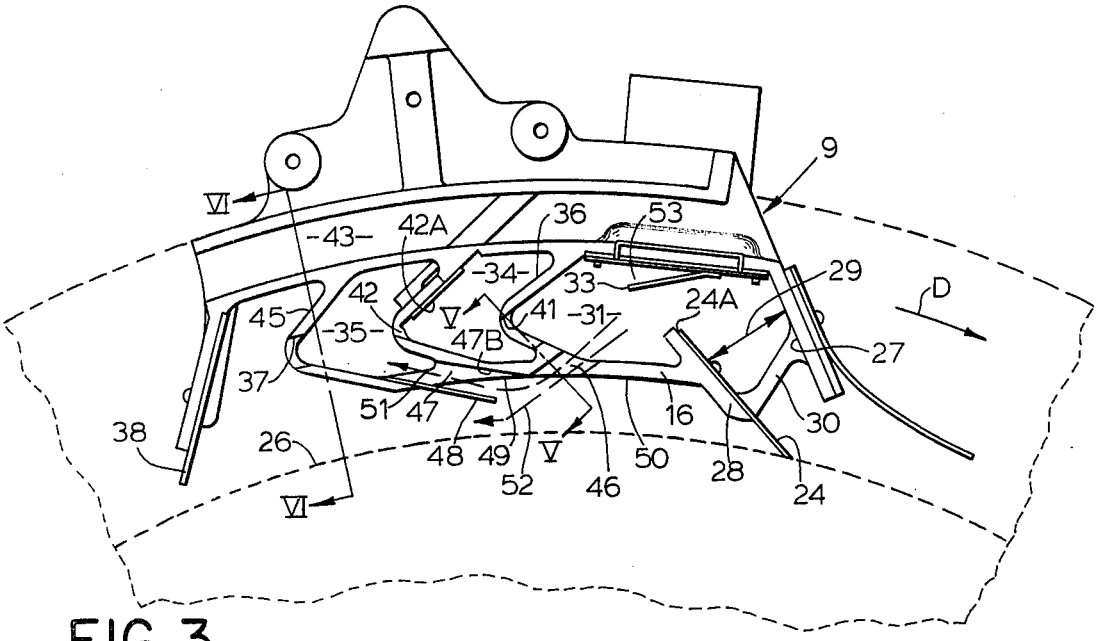
FIG. 3 is a view of the feed frame of FIG. 2 from the underside thereof and showing the rotary table in phantom.
Figure 4:
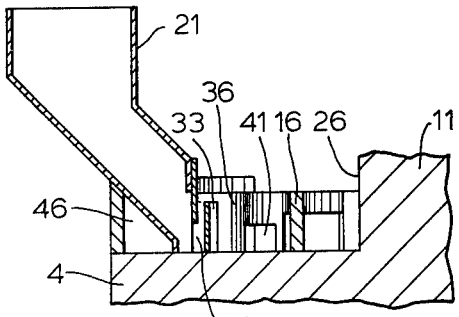
FIG. 4 is a section taken on the line IV—IV of FIG. 2 and showing the relationship of the hopper to the feed frame and rotary table.
Figure 5:
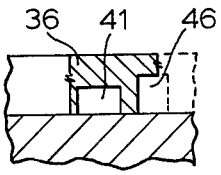
FIG. 5 is a section taken on the line V—V of both of FIGS. 2 and 3, said line V—V being the same line in both of said figures.
Figure 6:
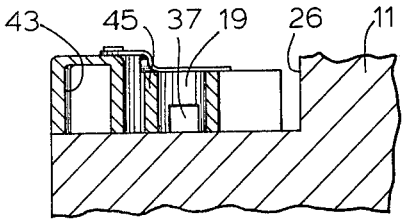
FIG. 6 is a section taken on the line VI—VI of FIGS. 2 and 3, said line VI—VI being the same line in both of said figures.
Figure 7:
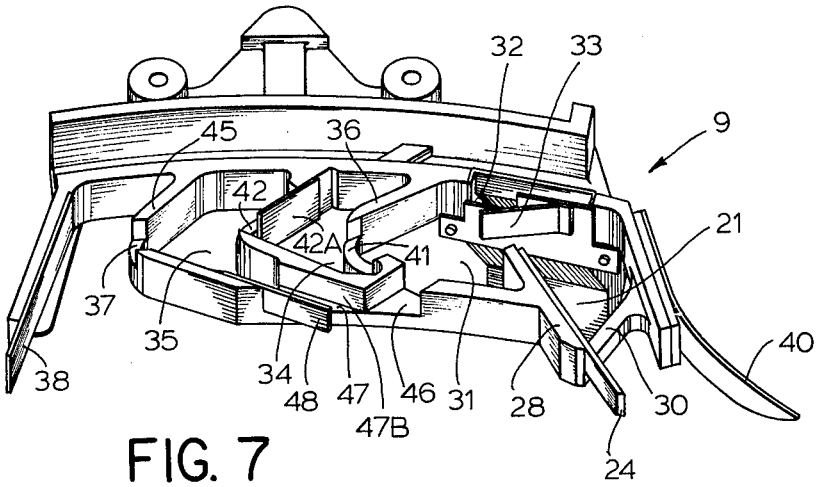
FIG. 7 is an oblique, underside, view of a feeder embodying the invention showing other constructional details thereof.

Turning now to the structure of the feed frame 9 in more detail, the particular feed frame here used to illustrate the invention is mounted on the tableting machine by posts 22 and 23 (FIG. 1). The feed box 21 has an interchangeable gate 20 (FIG. 2). The deflector 33 is mounted on the gate 20 and blocks the opening 32 from powders entering said compartment from the opening 29 (FIG. 3). The feed frame 9 has a wall 28 with a blade 24 thereon for scraping powder adjacent the vertical surface 26 (FIG. 4) of the hub 11. The powder so scraped goes between said blade and a forwardly projecting guide member 27 of the feed frame (said blade and guide member defining the feed opening 29 into said frame) and under the bar 30 for conducting powder in the zone A into the first compartment 31 of said feed frame. Powder also descends from the hopper 8 to the feed box 21 and thence through an opening 32 into the compartment 31.

A wall 36 defines the rearward extent of the compartment 31 and divides said compartment from a second compartment 34. Said compartment 34 is also defined at its rearward end by a wall which separates said compartment 34 from compartment 35. Said compartment 35 has a trailing wall 45 defining the rearward extent thereof.

An opening 41 through the wall 36 provides communication between the compartment 31 and the compartment 34 and an opening 42 provides communication from the compartment 34 to the last compartment 35. A slide 42A adjusts the size of opening 42. An opening 37 provides exit for powders within the compartment 35 to the outside of said feed frame 9 where they are engaged by the blade 38 for directing same toward and at least close to the surface 26 of the hub 11. In a machine having only a single hopper and feed frame, said powders then go all of the way around said hub and are caused by the blade 24 to go again through the opening 29 and into the feed frame compartment 31. Where as in the embodiment illustrated in FIG. 1, there are two hoppers, there will of course be two such feed frames and powders exiting from the rear of one feed frame via the opening 37 will enter into the opening 29 of the next following feed frame. It will be recognized that each of the openings 41, 42 and 37 are positioned radially inwardly of the circumferential line on which the die openings are placed in order that the wall 36, the adjustable partition 42A and the wall 45 will act as scrapers scraping powder into said die openings.

A blade 40 is positioned on the leading wall 18A (of which the guide member 27 is a continuation) of the feed frame and acts in a conventional manner to guide formed tablets which have been ejected from the tableting dies to the desired point of further handling. In this embodiment, shown as is conventional, a passageway or tunnel 43 is at the radially outer portion of said feed frame. This is used where multiple feed frames are used on a given machine but only a single offtake point is provided for the formed tablets. This tunnel is provided on the feed frames remote from the offtake point to permit tablets guided by the blade 40 to be discharged into the outer zone B of the stepped surface 12, thence through the tunnel 43 to remain on said stepped surface until they reach a blade (not shown) which is part of the tablet machine discharge mechanism. With such latter feed frame, the leading end 44 of said tunnel 43 is closed and the tablets are thus caused to leave the stepped surface 12 at a point C thereon immediately ahead of said leading end 44.

All of the foregoing is already known but has been described in considerable detail to insure a full understanding of the specific apparatus with which the invention is here utilized. It will be understood, however, that the principles of the invention are applicable to other specific forms of feed frames and hence it will be understood that the specific form here illustrated and described is for illustrative purposes only and that the principles of the invention may be applied freely to other specific forms of feed frame constructions having the same general arrangement.

Turning now to the portions of the illustrated feed frame comprising the invention, there is provided through the wall 16 thereof near the rearward end of the compartment 31 a relief opening 46 extending from said compartment 31 to the exterior of said feed frame at the radially inner side thereof. There is further provided an additional bypass opening 47 through said inner wall 16 from the rearwardmost compartment 35 to the exterior thereof on the radially inner side of said feed frame, the relief opening 46 being aligned on an axis angling radially inwardly and away from the direction of relative travel of the feed frame with respect to said table, said direction of relative travel being indicated by the arrow D in FIG. 3, in this case the axis of said opening 43 being approximately 45° with respect to the radius of said table passing therethrough. The bypass opening 47 angles forwardly, namely toward said direction of travel indicated by the arrow D and in this embodiment does so at a somewhat greater angle, in this embodiment approximately 60° with respect to a radius passing therethrough. The bypass opening 47 is supplemented by a blade 48 positioned parallel to the wall 47B of the opening 47 to position the mouth 49 of said bypass opening 47 close to the discharge point of the relief opening 46 but nevertheless spaced from the wall 26 of the hub 11. Thus, when small quantities of powder exit from the relief opening 46, same will proceed as far as the radially inner surface 50 of the wall 16 and then be carried by the moving table 4 to the mouth 49 and thence conducted through the bypass opening 47 to the compartment 35. Larger quantities, however, which may exit from the relief opening 46 will be pushed past the mouth 49 and pass between the tip of the blade 48 and the wall 26 whereby to be carried around the machine and ultimately back into the compartment 31.

OPERATION

In considering the operation of the invention described herein, it should be remembered that it is often extremely difficult to secure uniform feed from a hopper such as the hopper 8 onto the stepped portion 12 of the rotating table. A variety of devices have been used in an attempt to secure such uniform feed but these have at best been only partially successful and it is therefore assumed that powder will exit from the hopper 8 through the opening 32 in a series of surges into the compartment 31. Thus, while the average feed may be correct for filling the die openings in the rotating table 4, the feed at any given instant is likely to be either greater or less than that required.

Considering first the high point of a surge, a larger than needed amount of powder is introduced into the compartment 31 and such amount is greater than will properly pass through the opening 41. If unrelieved, such powder is likely to cake around said opening 41, possibly bridge over same, and result in a malfunctioning of the machine. However, with the relief opening 46, powder in moderate quantities will pass therethrough following the broken line arrow indicated at 51 into the trailing compartment 35 where it can be blended with powder entering into the compartment 35 from the opening 42 and thereupon dealt with in a conventional manner. If there are excessive quantities of powder in the compartment 31, same can follow the path of the arrow 52 beyond the blade 48 and be carried back to join the powder exiting from the exit opening 37 to go around the machine for re-entry into the opening 29 as above described. Powder exiting from relief opening 46 will be somewhat spread along the surface 26 as the table rotates and will thus return to opening 29 in a somewhat more uniform manner than the original surge. Thus, said excess powders in the compartment 31 will have two relief paths, namely the path 51 or the path 52 depending on the quantity thereof and will thereby avoid the jamming, caking and bridging at either or both of the openings 41 and 42 which would otherwise occur. This then relieves the peaks of the surges but provides a supply of powder entering the compartment 31 by the opening 29 which when it enters thereinto in a valley between two surges will provide the needed supplementary powder to fill said compartment 31 and thereby properly fill the die openings of the rotating table 4. Powders entering the opening 29 at the peak of a surge into compartment 31 are simply dealt with the same as the surge itself and may be again bypassed as above described.

It will be noted that the trailing end of the blade 24 is radially outwardly of the entrance to the bypass opening 46 but radially inwardly of the zone 53 at which powder from the opening 32 enters into the compartment 31. Thus, powders entering the opening 29 and passing the end 24A of the blade 24 will tend to move outwardly in response to centrifugal force and blend with the powders entering into the compartment 31 from said opening 32.

Thus, the presence of the bypass openings 46 and 47 provide for smoothing out, or attenuating, surges of feed and effectively prevent the jamming, caking and bridging of powders as same often otherwise occur at the openings 41 and 42 in those feed frames where said bypass openings are not used.

In addition, there has been noted some tendency for powders fed into the compartment 31 to respond to centrifugal motion and tend to laminate in radially arranged zones therein, the larger and heavier particles on the radial outside and finer particles on the radial inside. This likewise tends to disturb the uniformity of feed to the tableting dies but with the withdrawal of powders along the radially inside edge of the compartment 31 through the opening 46 and their partial remixing in the compartment 35 and further remixing subsequently through the opening 29, said tendency for lamination is effectively broken up and the uniformity of powders made available to the tableting dies further enhanced.

It will be further observed that under normal feed conditions or under conditions existing between surges, the centrifugal force acting on the powder will hold same toward the radial outside of the walls defining the compartment 31 and there will be little if any tendency for powders to pass through the bypass opening 46. However, as surge conditions are approached, and the compartment 31 fills, then powders will be forced radially inwardly of said compartment and become positioned for exiting through the passageway 46 with subsequent treatment as above described.

Although particular preferred embodiments of the above-described invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An apparatus for feeding pharmaceutical powders to successively presented tableting dies and comprising a hollow enclosure positioned on a die carrying table for relative movement with respect thereto, said enclosure including a wall trailing with respect to said relative motion for scraping powders within said enclosure into successively presented dies, and said enclosure having an exit opening therefrom at the radially inner end of said wall, the improvement comprising:

a relief opening from said enclosure through a wall thereof which is radially inwardly of said above-named exit opening for permitting the escape from said enclosure of powder in excess of that which is able to escape through said above-mentioned exit opening.

2. The device of claim 1 wherein said feed frame defines a plurality of hollow enclosures successively presented to said successively arranged dies and each thereof having an opening through a wall providing communication from one enclosure to the next and from the last enclosure to the exterior thereof, the further improvement comprising:

a bypass opening through the radially inner wall of a trailing enclosure for conducting powder exiting from said above-mentioned relief opening through said bypass opening into said trailing enclosure.

3. The device of claim 2 wherein said die carrying table includes a hub having an upstanding wall spaced radially inwardly from said dies and including guide means comprising a blade extending from the trailing wall of said bypass opening to a point between a radially inner wall of said feed frame and said upstanding wall whereby powders exiting from said relief opening in small quantities will remain close to said inner wall and be guided by said guide means through said bypass opening into said trailing enclosure but powders exiting from said relief opening in larger quantities will partially be pushed radially inwardly of the end of said guide means and passed beyond same.

4. The device of claim 2, wherein said bypass opening is positioned at an angle of approximately 60° with respect to a radius of said die table therethrough and is sensed to angle radially inwardly and toward the direction of motion of said feed frame with respect to said die table.

5. The device of claim 1, wherein said relief opening is positioned at an angle of approximately 45° with respect to a radius of the die table passing therethrough and in a sense to discharge powders passing therethrough in a direction opposite to the relative motion of said feed frame with respect to said table.

6. The device of claim 1, wherein said feed frame defines at least three of said hollow enclosures disposed in series so as to be successively presented to said successively arranged dies, each of said hollow enclosures having a said exit opening through a wall for providing communication from one enclosure to the next and from the last enclosure to the exterior thereof, said relief opening being in communication with the leading enclosure for permitting the escape therefrom of the excess powder, and a bypass opening through the radially inner wall of a trailing enclosure which is separated from said leading enclosure by at least one intermediate enclosure, whereby at least some of the excess powder exiting from the relief opening associated with said leading enclosure will pass through said bypass opening into said trailing enclosure so that said excess powder will totally bypass said intermediate enclosure.

7. In apparatus for feeding powders to successively presented tableting dies, comprising a powder feed frame positioned on a die carrying table for relative movement with respect thereto, said feed frame including wall means defining a plurality of powder receiving compartments disposed in series, said plurality of compartments including leading and trailing compartments separated by at least one intermediate compartment, said wall means including a trailing wall associated with each said compartment for scraping powders within each said compartment into successively presented dies and an exit opening in the trailing wall of each said compartment for permitting the powder to pass successively from the leading compartment into the intermediate compartment and then into the trailing compartment and thence to the exterior of the feed frame, the improvement comprising a relief opening from said leading compartment through a wall thereof for permitting the escape from said leading compartment of powder in excess of that which is able to escape through the exit opening associated with said leading compartment, said relief opening being positioned radially from said last-mentioned escape opening for feeding the excess powder radially of the feed frame onto the die carrying table so that the excess powder is not supplied to said intermediate compartment.

8. An apparatus according to claim 7, wherein a bypass opening extends through a wall of said trailing compartment for conducting excess powder exiting from said relief opening into said trailing compartment while bypassing said intermediate compartment.

* * * * *

UNITED STATES PATENT AND TRADEMARK OFFICE

CERTIFICATE OF CORRECTION

PATENT NO. : 4 157 148

DATED : June 5, 1979

INVENTOR(S) : Gilbert H. White

It is certified that error appears in the above-identified patent and that said Letters Patent are hereby corrected as shown below:

Column 6, line 61; After "comprising" insert ---a feeding frame defining---.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*